United States Patent [19]

Erickson

[11] Patent Number: 4,957,462

[45] Date of Patent: Sep. 18, 1990

[54] ENGINE MOUNT INSTALLATION TOOL AND METHOD

[75] Inventor: James E. Erickson, Fond du Lac, Wis.

[73] Assignee: Brunswick Corporation, Skokie, Ill.

[21] Appl. No.: 353,875

[22] Filed: May 18, 1989

[51] Int. Cl.[5] ..... B63H 5/12

[52] U.S. Cl. ..... 440/111; 248/544; 33/645

[58] Field of Search ..... 440/83, 61, 57, 111, 440/112, 113; 248/544, 632, 635, 638, 640, 637; 180/312; 33/600, 606, 645; 29/464, 468, 271, 281.5

[56] References Cited

U.S. PATENT DOCUMENTS

| | | | |
|---|---|---|---|
| 2,059,220 | 11/1936 | Fernstrum | 440/111 |
| 3,128,741 | 4/1964 | Benjamen | 440/112 |
| 3,403,655 | 10/1968 | Warburton | 440/57 |
| 4,666,412 | 5/1987 | Rawlings | 440/111 |
| 4,778,420 | 10/1988 | Greenberg | 440/111 |

OTHER PUBLICATIONS

OMC Publication of May 1985, Showing Alignment Tools.

1986 Mercrusier Brochure.

Mercruiser Service Training Notebook.

OMC "Front Mount Alignment Drill Fixture", Part No. 984325 and Alignment Tool, Part No. 912274.

*Primary Examiner*—Joseph F. Peters, Jr.

*Assistant Examiner*—Edwin L. Swinehart

*Attorney, Agent, or Firm*—Andrus, Sceales, Starke & Sawall

[57] ABSTRACT

In a marine stern drive (22) having an inboard engine (23), an outdrive (24) with a gimbal bearing (26) at the transom (28) of a boat (30), and a drive coupler shaft (34) extending through the gimbal bearing (26) and between the outdrive (24) and the engine (23), an engine mount installation tool (20) locates the front engine mounts (46 and 48) horizontally on stringers (42 and 44) in the boat prior to installation of the engine (23) to horizontally prealign the front engine mounts (46 and 48) with the front supports (54 and 56) on the engine. The tool (20) includes vertical alignment structure (104, 86, 88) vertically locating the proper height of the front engine mounts (46 and 48) prior to installation of the engine (23) to pre-set the height adjustment of the front of the engine (23) to assure proper alignment of the engine (23) with the gimbal bearing (26) after installation of the engine (23).

18 Claims, 4 Drawing Sheets

FIG. 2
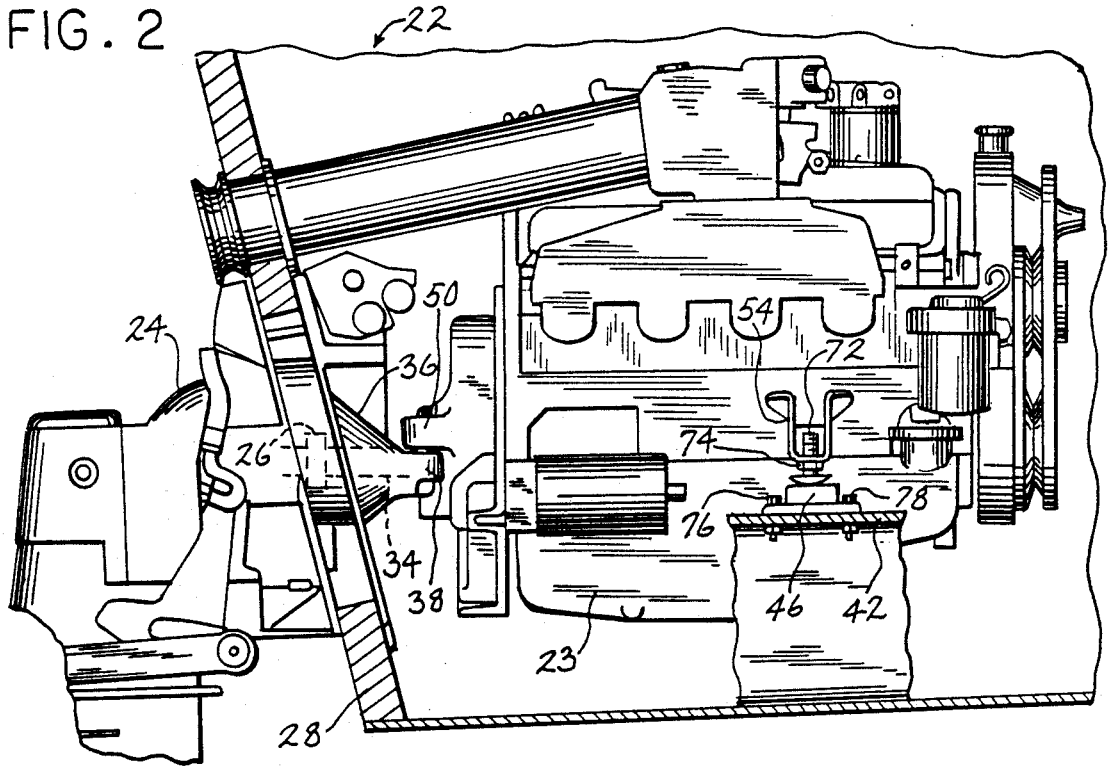
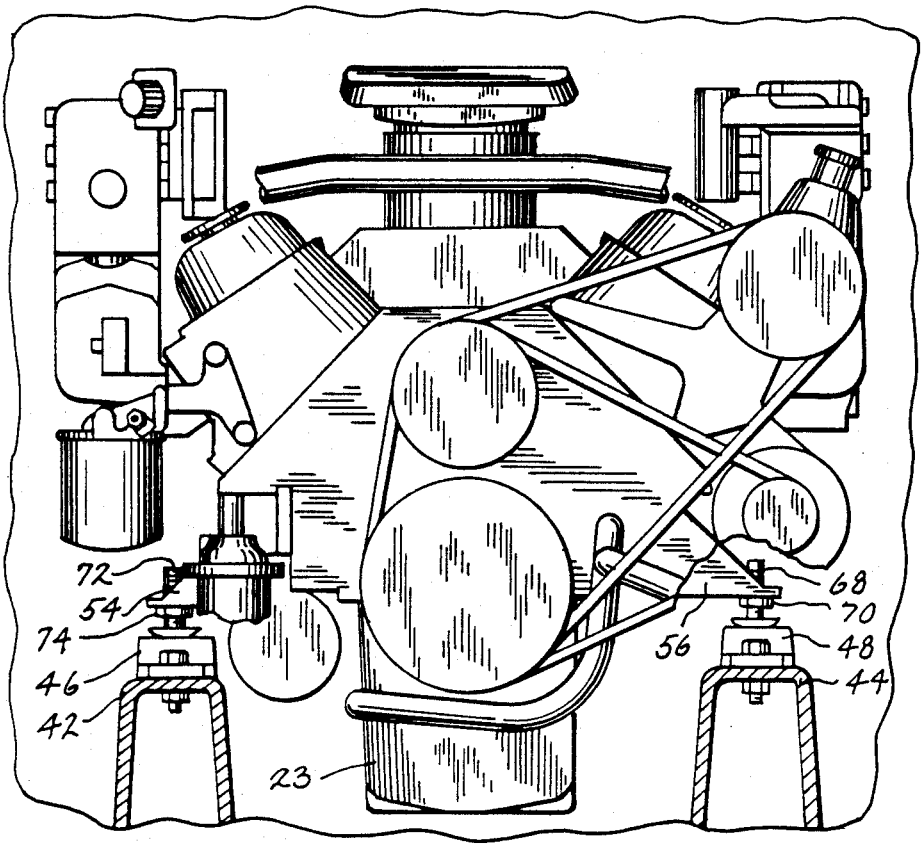
FIG. 3

ENGINE MOUNT INSTALLATION TOOL AND METHOD

BACKGROUND AND SUMMARY

The invention relates to marine stern drives, and more particularly to a tool and method for installing the engine.

A marine stern drive has an inboard engine, an outdrive with a gimbal bearing at the transom of the boat, and a drive coupler shaft extending through the gimbal bearing and between the outdrive and the engine. The drive coupler shaft extends from a universal joint in the outdrive forwardly through the gimbal bearing and into the flywheel output coupler of the engine. The outdrive is secured to the transom by an inner transom plate having a pair of engine supports thereon for supporting the rear of the engine. The boat has a pair of longitudinal stringers with a pair of engine mounts thereon for supporting the front of the engine. The engine has a pair of rear mounts mounted on the rear engine supports on the inner transom plate. The engine has a pair of front supports mounted on the front engine mounts on the stringers. The front engine mounts are vertically adjustable to vary the height of the front of the engine to align the engine with the gimbal bearing, including proper alignment of the drive coupler shaft.

It is desirable for boat manufacturers to be able to pre-drill the front engine mount bolt or lag screw holes in the stringers prior to installing the engine. This is because in many engines the front engine mounts are located directly below the exhaust manifolds or other engine components, making it very difficult to drill the holes after the engine is installed, i.e. there is insufficient clearance between the front engine mounts and various engine components, such as the noted exhaust manifolds, to accommodate a drill. The boat manufacturer must remove the engine after marking the mounting hole locations on the stringers, to allow access for drilling the holes. The need to remove the engine adds significant extra time to the average installation, increasing the boat manufacturer's labor costs.

Installation tools are known in the prior art for locating the front engine mounts horizontally on the stringers prior to installation of the engine, to horizontally pre-align the front engine mounts with the supports on the engine. However, none of the tools provide vertical alignment locating the proper height of the front engine mounts prior to installation of the engine, to pre-set the height adjustment of the front of the engine to assure proper alignment of the engine with the gimbal bearing after installation of the engine. Sizeable vertical adjustments to the front engine mounts are difficult after the engine is installed.

The present invention addresses and solves the latter need, and provides a tool and method for locating the front engine mounts both vertically and horizontally. With the present invention, the vertical height adjustment of the front engine mounts is pre-set before installation of the engine, such that after the engine is installed, such vertical height adjustment need only be fine tuned, if necessary at all.

BRIEF DESCRIPTION OF THE DRAWINGS

FIG. 2 is a side view of a portion of a marine stern drive.

FIG. 3 is a front end view of the structure in FIG. 2.

DETAILED DESCRIPTION

Figure 1:
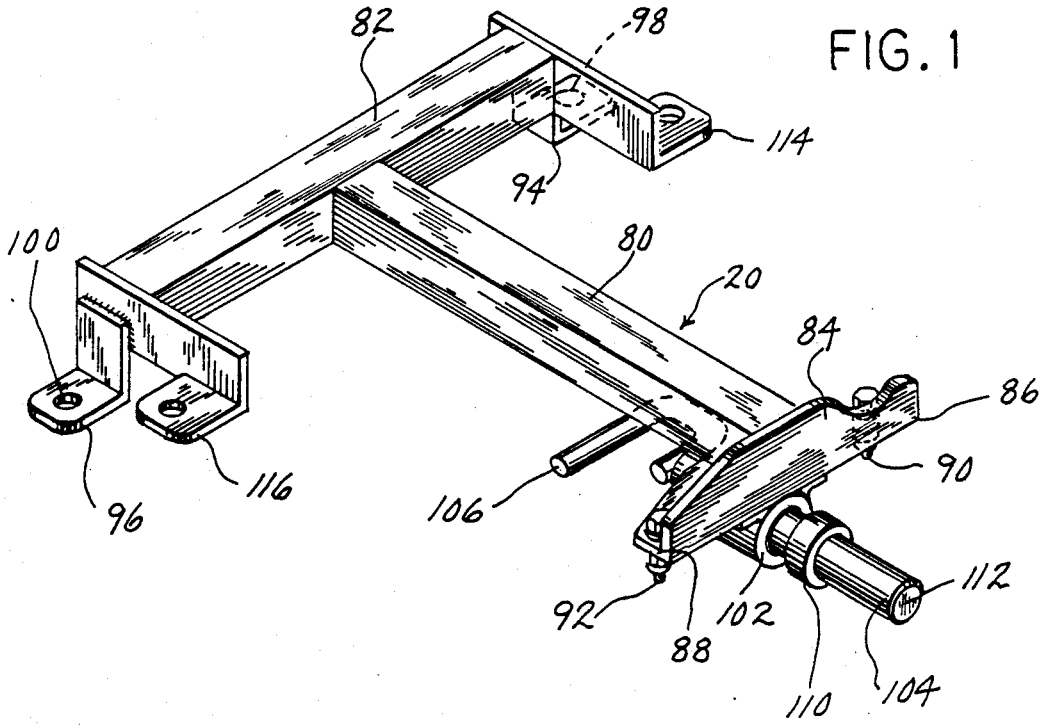
FIG. 1 is a perspective view of an installation tool in accordance with the invention.
Figure 5:
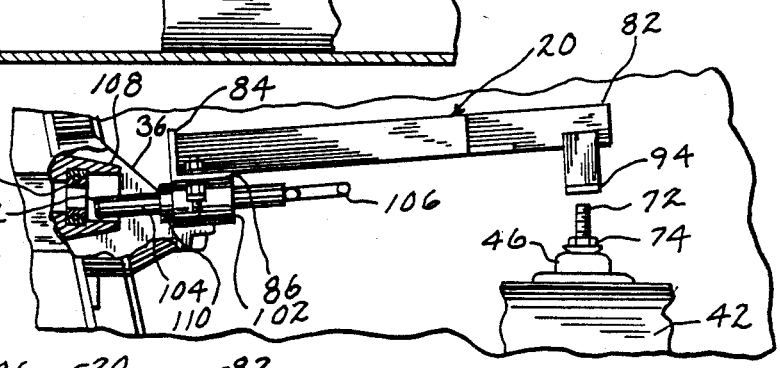
FIG. 5 is a view like FIG. 4, partially cut
Figure 10:
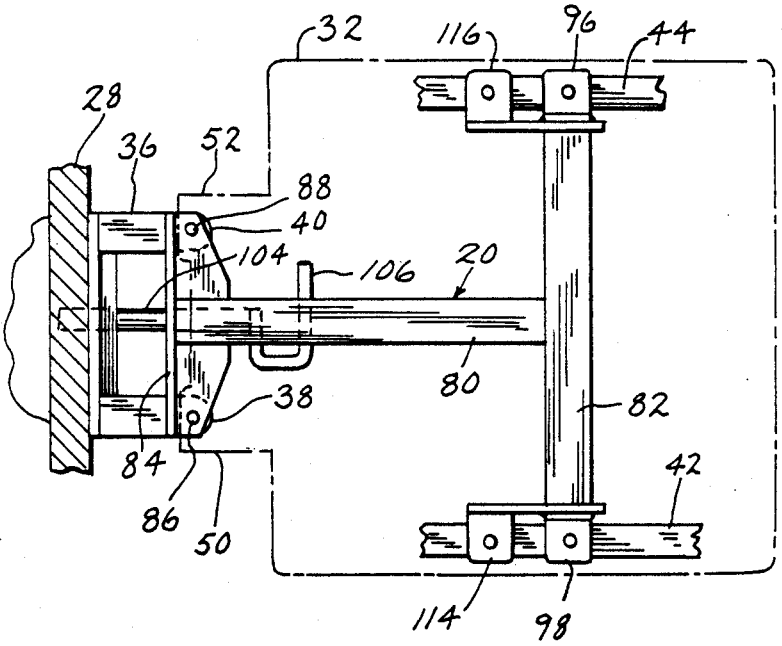
FIG. 10 is a partial schematic view from above of the structure in FIG. 4.
Figure 11:
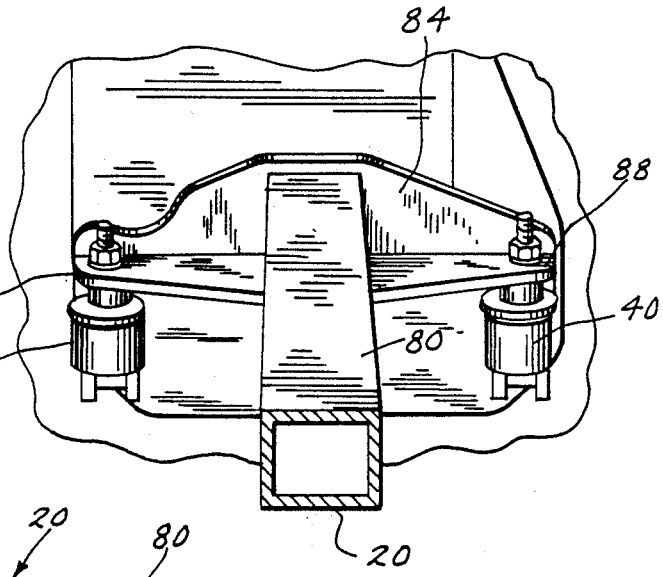
FIG. 11 is a perspective end view of a portion of FIG. 4.

FIG. 1 shows an installation tool 20 for a marine stern drive 22, FIG. 2, having an inboard engine 23, an outdrive 24 with a gimbal bearing 26, FIG. 5, at the transom 28 of a boat 30, and a drive coupler shaft 34 extending through gimbal bearing 26 and between the outdrive and the engine. Outdrive 24 is secured to transom 28 by an inner transom plate 36 having a pair of engine supports 38 and 40, FIGS. 2, 10 and 11, thereon for supporting the rear of engine 23. Boat 30 has a pair of longitudinal stringers 42 and 44, FIGS. 2 and 3, with a pair of engine mounts 46 and 48 thereon for supporting the front of engine 23. The engine has a pair of rear mounts at rear portions 50 and 52 mounted on rear engine supports 38 and 40, respectively, on inner transom plate 36. The engine has a pair of front supports 54 and 56 mounted on respective front engine mounts 46 and 48 on respective stringers 42 and 44.

Figure 12:
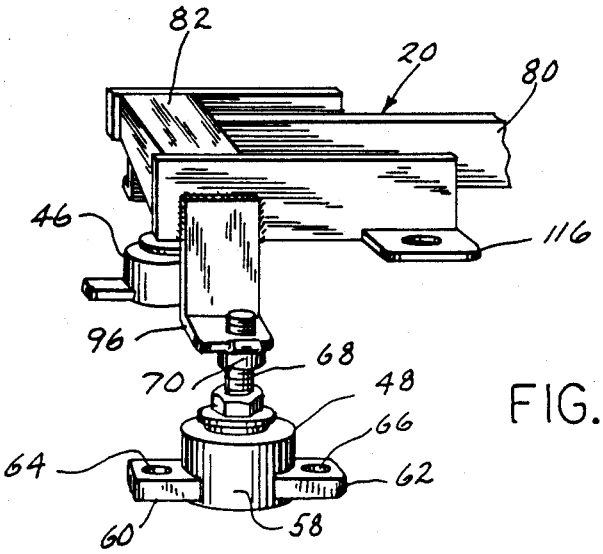
FIG. 12 is a perspective view of a portion of FIG. 7.

Each front engine mount includes a base portion for example as shown at 58 in FIG. 12 for mount 48, having a pair of flanges 60 and 62 extending distally horizontally oppositely therefrom. The flanges have mounting holes 64, 66 therein for mounting the respective front engine mount to the respective stringer. Mount 48 further includes a threaded stud 68 extending upwardly therefrom, and a nut 70 on the stud which is rotatable to move the nut up and down along the stud. Mount 46 is comparable, and includes a threaded stud 72, FIGS. 2 and 3, extending upwardly therefrom. Studs 68 and 72 of respective mounts 48 and 46 extend upwardly through apertures in respective front engine supports 56 and 54, with such supports resting on respective nuts 70 and 74. Rotation of the nuts varies the vertical height thereof along the respective stud to in turn adjust the height of the front of the engine to align the engine with gimbal bearing 26. The front engine mounts are mounted to their respective stringers by bolts such as 76, 78, FIG. 2, lag screws, or the like.

Tool 20, FIG. 1, includes a central longitudinal frame member 80 with front and rear cross piece ends 82 and 84. Rear cross piece end 84 has a pair of rear legs 86 and 88 placed on rear engine supports 38 and 40, respectively, FIG. 11, on inner transom plate 36. The legs include bolts with lower pins 90 and 92 received in respective supports 38 and 40. Front cross piece end 82 has a pair of front legs 94 and 96 above respective stringers 42 and 44 and horizontally locating proper placement of respective front engine mounts 46 and 48 both laterally and longitudinally in the horizontal plane. Legs 94 and 96 have respective apertures 98 and 100 receiving respective front engine mount studs 72 and 68 therein, FIGS. 6 and 12.

Figure 4:
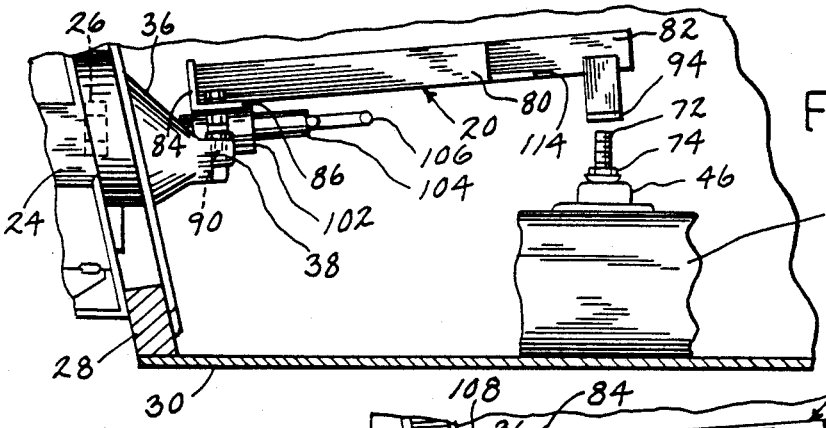
FIG. 4 is a side view of an installation tool in a marine stern drive and illustrates an initial sequence step.
Figure 6:
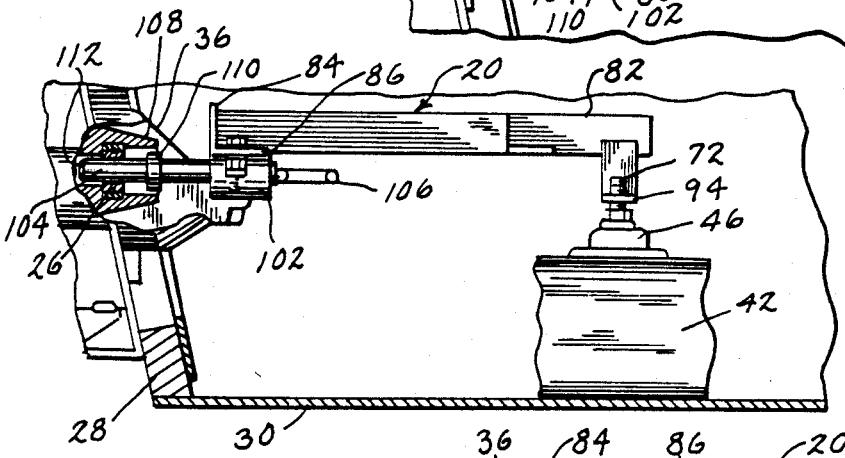
FIG. 6 is a view like FIG. 5 and shows a further sequence step.
Figure 7:
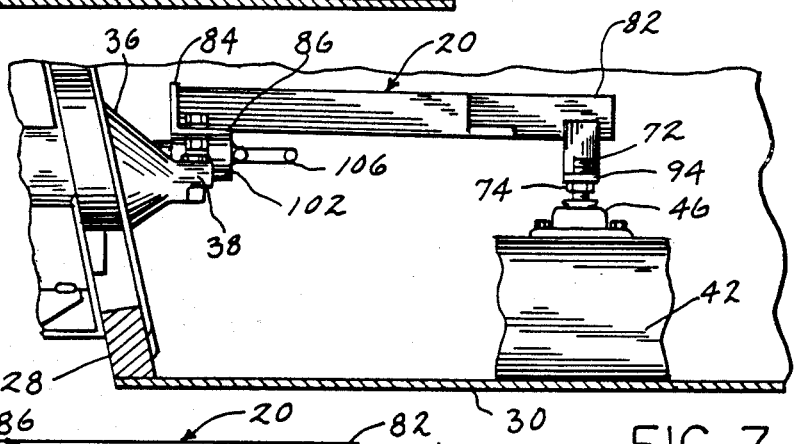
FIG. 7 is a view like FIG. 6 and shows a further sequence step.
Figure 8:
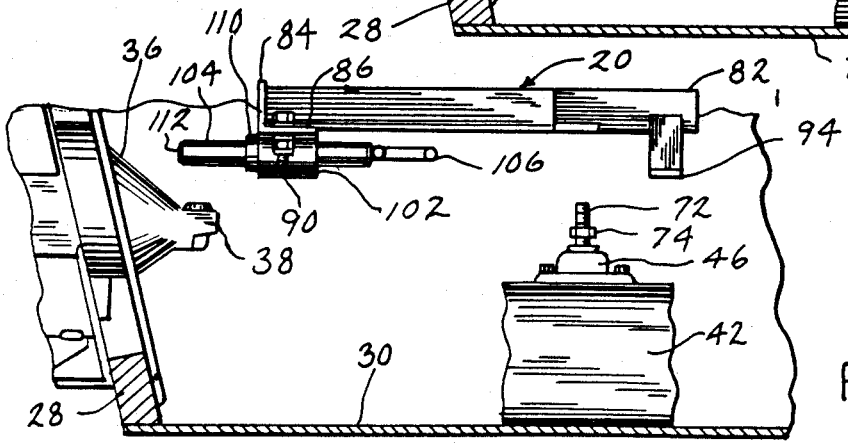
FIG. 8 is a view like FIG. 7 and shows a further sequence step.

Tool 20 includes a cylindrical bore 102 welded thereto, and an alignment shaft 104 axially slidable in bore 102 between a rearward extended position, FIGS. 6 and 7, and a forward retracted position, FIGS. 4 and 5. In the forward retracted position, shaft 104 is spaced forwardly of gimbal bearing 26 when rear legs 86 and 88 are on rear engine supports 38 and 40, to facilitate initial positioning of the tool, and then later removal of the tool. In FIG. 6, alignment shaft 104 extends rearwardly from rear end 84 of tool 20 into gimbal bearing 26 to support and vertically locate front end 82 of the tool such that front legs 94 and 96 have a vertically located height to which front engine mounts 46 and 48 are adjusted. Gimbal bearing 26 and rear engine supports 38 and 40 on inner transom plate 36 provide cantilevered triangulation supporting and locating tool 20 and alignment shaft 104 both vertically and horizontally.

Gimbal bearing 26 is rearward of rear engine supports 38 and 40 and provides a stop against upward movement of alignment shaft 104 and against pivoting of tool 20 on a fulcrum at rear engine supports 38 and 40 to in turn provide a stop against downward movement of front end 82 of the tool, and hence locate the vertical height of front legs 94 and 96. The vertical alignment structure provided by the noted cantilevered triangulation vertically locates the proper height for nuts 74 and 70 along respective studs 72 and 68 of respective front engine mounts 46 and 48 prior to installation of engine 23, to pre-set the height adjustment of the front of the engine to assure proper alignment of the engine with gimbal bearing 26 after installation of the engine, with only fine tuning of such adjustment thereafter, if necessary at all.

In the sequence illustrated in FIGS. 4–8, alignment shaft 104 is initially axially moved to its forward retracted position by handle 106 at the front end thereof. Tool 20 is then placed in the boat with rear legs 86 and 88 on rear engine supports 38 and 40. Front engine mounts 46 and 48 are placed on respective stringers 42 and 44, and front end 82 of the tool is lowered, and front engine mounts 46 and 48 are horizontally moved as necessary such that respective studs 72 and 68 are received in respective apertures 98 and 100 of respective front legs 94 and 96. This horizontally locates proper placement of front engine mounts 46 and 48 on the stringers 42 and 44 relative to rear engine supports 38 and 40 on inner transom plate 36. Handle 106 is then pushed rearwardly such that alignment shaft 104 moves rearwardly into gimbal bearing 26. Outdrive 24 includes an annular housing 108 around gimbal bearing 26, which housing has an internal diameter greater than the interal diameter of bearing 26. Alignment shaft 104 has an enlarged annular collar 110 thereon spaced forwardly of the rear end 112 of shaft 104 and received in annular housing 108, FIG. 6. Handle 106 provides a stop against further rearward movement of shaft 104. Collar 110 provides a stop which limits forward movement of shaft 104 in bore 102.

Upon rearward insertion of alignment shaft 104 into gimbal bearing 26, front end 82 of tool 20 is now vertically located due to the above noted cantilevered triangulation. Nuts 72 and 70 are then rotated to move same upwardly along their respective studs 72 and 68 until such nuts engage the bottom of respective front legs 94 and 96 of the tool, FIGS. 7 and 12. This vertically locates the height of front engine mounts 46 and 48 relative to gimbal bearing 26. Shaft 104 is then retracted forwardly out of engagement with gimbal bearing 26, and the tool is removed from the boat, FIG. 8.

Front engine mounts 46 and 48 may be mounted to their respective stringers by the noted bolts 76,78, lag screws, or the like, while tool 20 is in place in the boat, or after removal of the tool. While the tool is in place in the boat, FIGS. 6 and 7, front legs 94 and 96 still permit vertical access to the front engine mount flanges 60,62 from above to permit drill bit access downwardly into the stringer for drilling bolt or lag screw holes therein. As shown in FIG. 12, front leg 96 extends above base portion 58 of front engine mount 48 but not above openings 64 and 66 in flanges 60 and 62. This affords the noted vertical access to openings 64 and 66 in the flanges from above, to permit drill bit access downwardly into the stringer therebelow through openings 64 and 66 without removing tool 20. Alternatively, the bolt or lag screw hole locations can be marked, and tool 20 can be removed and the engine mount moved aside or left in place, and the bolt or lag screw holes can then be drilled into the stringer.

Figure 9:
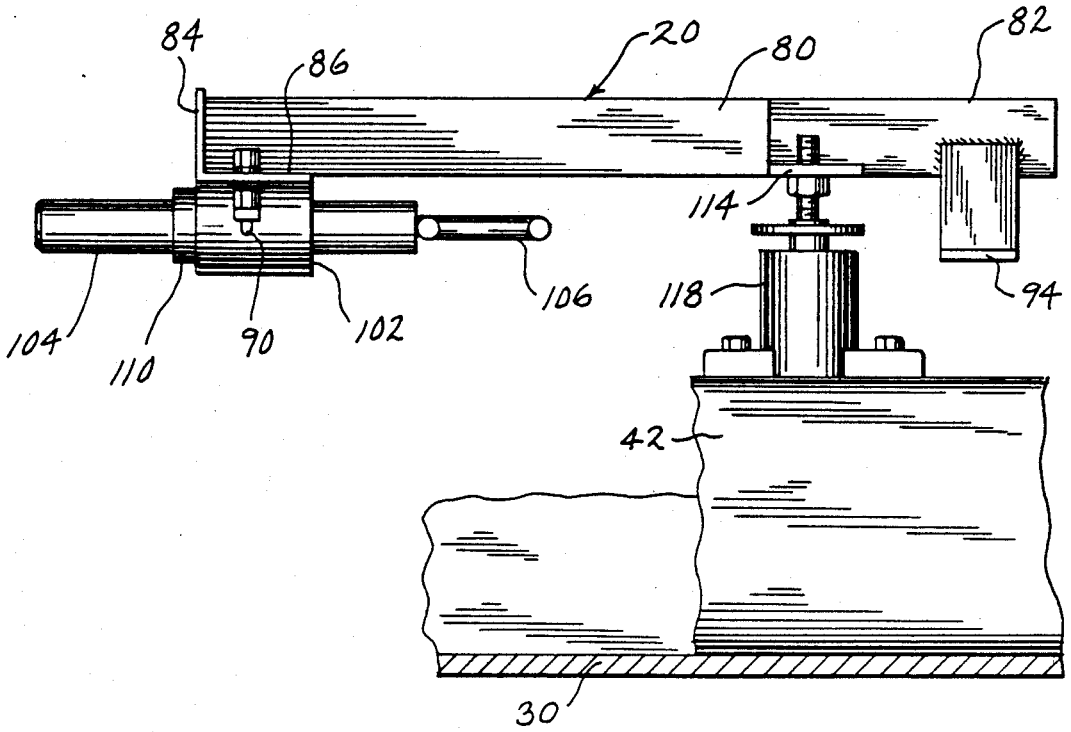
FIG. 9 is a view similar to a portion of FIG. 7 and shows another embodiment.

Tool 20 includes another pair of front legs 114 and 116, FIG. 1, providing both vertical and horizontal location for front engine mounts of a different engine. Legs 94 and 96 are for a V-8 engine, and legs 114 and 116 are for a V-6 engine. The tool has universal application. Legs 114 and 116 are spaced rearwardly of and are higher than legs 94 and 96. The V-6 engine has a higher front engine mount, as shown at 118 in FIG. 9.

It is recognized that various equivalents, alternatives and modifications are possible within the scope of the appended claims.

I claim:

1. In a marine stern drive having an inboard engine, an outdrive with a gimbal bearing at the transom of a boat, and a drive coupler shaft extending through said gimbal bearing and between said outdrive and said engine, said outdrive being mounted to said transom by an inner transom plate having a pair of engine supports thereon for supporting the rear of said engine, said boat having a pair of longitudinal stringers with a pair of engine mounts thereon for supporting the front of said engine, said engine having a pair of rear mounts mounted on said rear engine supports on said inner transom plate, said engine having a pair of front supports mounted on said front engine mounts on said stringers, said front engine mounts being vertically adjustable to vary the height of the front of said engine to align said engine with said gimbal bearing, an engine mount installation tool for locating said front engine mounts horizontally on said stringers prior to installation of said engine to horizontally pre-align said front engine mounts with said front engine supports said tool including vertical alignment structure vertically locating the proper height of said front engine mounts prior to installation of said engine to pre-set the height adjustment of the front of said engine to assure proper alignment of said engine with said gimbal bearing after installation of said engine.

2. The invention according to claim 1 wherein said tool has a pair of rear legs on said rear engine supports on said inner transom plate, and a pair of front legs above said stringers and horizontally locating proper placement of said front engine mounts therebelow on said stringers, and wherein said vertical alignment structure comprises an alignment shaft extending rearwardly from the rear end of said tool into said gimbal bearing to support and vertically locate the front end of said tool such that said front legs have a vertically located height to which said front engine mounts are adjusted.

3. The invention according to claim 2 wherein said gimbal bearing and said rear engine supports on said inner transom plate provide cantilevered triangulation supporting and locating said tool and alignment shaft both vertically and horizontally, said gimbal bearing being rearward of said rear engine supports and providing a stop against upward movement of said alignment shaft and against pivoting of said tool on a fulcrum at said rear engine supports to in turn provide a stop against downward movement of the front of said tool and locate the vertical height of said front legs.

4. The invention according to claim 3 wherein said tool includes a cylindrical bore, and said alignment shaft is axially slidable in said bore between a rearward extended position extending into said gimbal bearing when said rear legs are on said rear engine supports, and a forward retracted position spaced forwardly of said gimbal bearing when said rear legs are on said rear engine supports, to facilitate initial positioning of said tool and then later removal of said tool.

5. In a marine stern drive having an inboard engine, an outdrive with a gimbal bearing at the transom of a boat, and a drive coupler shaft extending through said gimbal bearing and between said outdrive and said engine, said outdrive being mounted to said transom by an inner transom plate having a pair of engine supports thereon for supporting the rear of said engine, said boat having a pair of longitudinal stringers with a pair of engine mounts thereon for supporting the front of said engine, said engine having a pair of rear mounts mounted on said rear engine supports on said inner transom plate, said engine having a pair of front supports mounted on said front engine mounts on said stringers, each of said front engine mounts comprising a base portion having a pair of flanges extending distally horizontally oppositely thereform, each flange having a mounting hole therein for mounting said front engine mount to said stringer, each said front engine mount further comprising a threaded stud extending upwardly thereform, and a nut on said stud, said stud extending upwardly through said front engine support, with said front engine support resting on said nut, said nut being rotatable to vary the vertical height thereof along said stud to in turn adjust the height of the front of said engine to align said engine with said gimbal bearing, an engine mount installation tool for locating said front engine mounts horizontally on said stringers prior to installation of said engine to horizontally pre-align said front engine mounts with said front engine supports, said tool including vertical alignment structure vertically locating the proper height of said nuts along said studs of said front engine mounts prior to installation of said engine to pre-set the height adjustment of the front of said engine to assure proper alignment of said engine with said gimbal bearing after installation of said engine, said tool having a pair of rear legs on said rear engine supports on said inner transom plate, said tool having at least one pair of front legs above said stringers, each front leg having an opening therein for receiving a respective said stud of a respective said front engine mount and horizontally locating proper placement of said front engine mount therebelow on said stringer, each said front leg extending above said base portion of the respective said front engine mount but not above said openings in said flanges of said front engine mount to afford vertical access to said openings in said flanges from above to permit drill bit access downwardly into said stringer through said openings in said flanges of said front engine mount without removing said tool, said vertical alignment structure comprising an alignment shaft extending rearwardly from the rear end of said tool into said gimbal bearing to support and vertically locate the front end of said tool such that said front legs have a vertically located height to which said nuts on said studs are rotated upwardly into engagement with the bottom of the respective said front leg.

6. The invention according to claim 5 comprising a plurality of pairs of front legs on said tool, each pair providing both vertical and horizontal location for front engine mounts of a different engine, to provide a universal said tool for installing different engines.

7. The invention according to claim 6 comprising a first pair of said front legs, and a second pair of said front legs spaced rearwardly of said first pair and having a different vertical height than said first pair.

8. The invention according to claim 5 wherein each of said rear legs of said tool has a pin extending downwardly thereform into a respective said rear engine support on said inner transom plate.

9. In a marine stern drive having an inboard engine, an outdrive with a gimbal bearing at the transom of a boat, a drive coupler shaft extending through said gimbal bearing and between said outdrive and said engine, said outdrive being mounted to said transom by an inner transom plate having a pair of engine supports thereon for supporting the rear of said engine, said boat having a pair of longitudinal stringers with a pair of engine mounts thereon for supporting the front of said engine, said engine having a pair of rear mounts mounted on said rear engine supports on said inner transom plate, said engine having a pair of front supports mounted on said front engine mounts on said stringers, said front engine mounts being vertically adjustable to vary the height of the front of said engine to align said engine with said gimbal bearing, an engine mount installation tool for locating said front engine mounts horizontally on said stringers prior to installation of said engine to horizontally pre-align said front engine mounts with said front engine supports, and also locating the height of said front engine mounts prior to installation of said engine to pre-set the height adjustment of the front of said engine to assure proper alignment of said engine with said gimbal bearing after installation of said engine, said tool comprising a pair of rear legs on said rear engine supports on said transom plate, said tool comprising a pair of front legs above said stringers and horizontally locating proper placement of said front engine mounts therebelow on said stringers, said tool comprising a cylindrical bore and an alignment shaft axially slidable in said bore between a rearward extended position extending rearwardly from the rear end of said tool into said gimbal bearing to support and vertically locate the front end of said tool such that said front legs have a vertically located height to which said front engine mounts are adjusted, said tool comprising a handle at the front end of said alignment shaft limiting rearward extension of said alignment shaft into said gimbal bearing said handle being gripable by the user to move said alignment shaft forwardly to a forward retracted position spaced forwardly of said gimbal bearing.

10. The invention according to claim 9 wherein said outdrive includes an annular housing around said gimbal bearing and extending forwardly therefrom and having an inner diameter greater than the inner diameter of said gimbal bearing, said alignment shaft has an enlarged annular collar thereon spaced forwardly of the rear end of said alignment shaft and received in said annular housing when said alignment shaft is extended rearwardly into said gimbal bearing.

11. A method for installing an engine in a marine stern drive having an inboard engine, an outdrive with a gimbal bearing at the transom of a boat, and a drive coupler shaft extending through said gimbal bearing and between said outdrive and said engine, said outdrive being mounted to said transom by an inner transom plate having a pair of engine supports thereon for supporting the rear of said engine, said boat having a pair of longitudinal stringers with a pair of engine mounts thereon for supporting the front of said engine, said engine having a pair of rear mounts mounted on said rear engine supports on said inner transom plate, said engine having a pair of front supports mounted on said front engine mounts on said stringers, said front engine mounts being vertically adjustable to vary the height of the front of said engine to align said engine with said gimbal bearing, said method comprising horizontally locating proper placement of said front engine mounts on said stringers relative to said rear engine supports on said inner transom plate prior to installation of said engine to horizontally pre-align said front engine mounts with said front engine supports, vertically locating the height of said front engine mounts relative to said gimbal bearing prior to installation of said engine to pre-set the height adjustment of the front of said engine to assure proper alignment of said engine with said gimbal bearing after installation of said engine, installing said engine with said rear engine mounts on said rear engine supports on said inner transom plate and with said front engine supports on said front engine mounts on said stringers, and comprising providing a tool for horizontally locating said front engine mounts on said stringers relative to said rear engine supports on said inner transom plate, and using the same said tool to vertically locate the height of said front engine mounts to pre-set the height adjustment of the front of said engine prior to installation of said engine.

12. The invention according to claim 11 comprising providing a cylindrical bore on said tool, providing an alignment shaft axially slidable in said bore between a rearward extended position and a forward retracted position, providing a pair of rear legs on said tool, and providing a pair of front legs on said tool, said method further comprising moving said alignment shaft forwardly to said forward retracted position, placing said rear legs of said tool on said rear engine supports on said inner transom plate, moving said alignment shaft rearwardly into said gimbal bearing in said rearward extended position, marking the mounting location of said front engine mounts on said stringers below said front legs, adjusting the vertical height of said front engine mounts according to the height of said front legs, moving said alignment shaft forwardly to said forward retracted position, and removing said tool.

13. The invention according to claim 12 wherein each of said front engine mounts has a threaded stud extending upwardly, and a nut thereon rotatable to move up and down along said stud to provide said vertical height adjustment, and wherein each of said front legs has an opening therein through which a respective said stud extends to provide said horizontal alignment, said method further comprising rotating said nut against the bottom of a respective said front leg to provide said vertical height adjustment.

14. A method for installing an engine in a marine stern drive having an inboard engine, an outdrive with a gimbal bearing at the transom of a boat, and a drive coupler shaft extending through said gimbal bearing and between said outdrive and said engine, said outdrive being mounted to said transom by an inner transom plate having a pair of engine supports thereon for supporting the rear of said engine, said boat having a pair of longitudinal stringers with a pair of engine mounts thereon for supporting the front of said engine, said engine having a pair of rear mounts mounted on said rear engine supports on said inner transom plate, said engine having a pair of front supports mounted on said front engine mounts on said stringers, said front engine mounts being vertically adjustable to vary the height of the front of said engine to align said engine with said gimbal bearing, said method comprising horizontally locating proper placement of said front engine mounts on said stringers relative to said rear engine supports on said inner transom plate prior to installation of said engine to horizontally pre-align said front engine mounts with said front engine supports, vertically locating the height of said front engine mounts relative to said gimbal bearing prior to installation of said engine to pre-set the height adjustment of the front of said engine to assure proper alignment of said engine with said gimbal bearing after installation of said engine, and comprising providing a tool for horizontally locating said front engine supports on said stringers relative to said rear engine supports on said inner transom plate, and using the same said tool to vertically locate the height of said front engine mounts to pre-set the height adjustment of the front of said engine prior to installation of said engine, and comprising providing a cylindrical bore on said tool, providing an alignment shaft axially slidable in said bore between a rearward extended position and a forward retracted position, providing a pair of rear legs on said tool, and providing a pair of front legs on said tool, said method further comprising moving said alignment shaft forwardly to said forward retracted position, placing said rear legs of said tool on said rear engine supports on said inner transom plate, moving said alignment shaft rearwardly into said gimbal bearing in said rearward extended position, placing said front engine mounts on said stringers below said front legs, attaching said front engine mounts to said stringers, adjusting the vertical height of said front engine mounts according to the height of said front legs, moving said alignment shaft forwardly to said forward retracted position, removing said tool, and installing said engine with said rear engine mounts on said rear engine supports and said front engine supports on said front engine mounts.

15. The invention according to claim 14 wherein said front engine mounts have flanges with mounting holes therein for mounting same to said stringers, and comprising drilling bores into said stringers through said mounting holes in said flanges with said tool in place, without temporarily removing said tool and then replacing same after said drilling step.

16. The invention according to claim 14 comprising attaching said front engine mounts to said stringers without removing said tool.

17. The invention according to claim 14 comprising attaching said front engine mounts to said stringers after removal of said tool.

18. The invention according to claim 14 wherein each of said front engine mounts has a threaded stud extending upwardly, and a nut thereon rotatable to move up and down along said stud to provide said vertical height adjustment, and wherein each of said front legs has an opening therein through which a respective said stud extends to provide said horizontal alignment, said method further comprising rotating said nut against the bottom of a respective said front leg to provide said vertical height adjustment.

* * * * *